US010648265B2

(12) United States Patent
Kinsella et al.

(10) Patent No.: US 10,648,265 B2
(45) Date of Patent: May 12, 2020

(54) LATERAL DRILLING METHOD

(71) Applicant: IMPULSE DOWNHOLE SOLUTIONS LTD., Edmonton (CA)

(72) Inventors: Douglas Kinsella, Sturgeon County (CA); Kevin Leroux, Beaumont (CA); Troy Lorenson, Edmonton (CA); Dwayne Parenteau, Edmonton (CA)

(73) Assignee: IMPULSE DOWNHOLE SOLUTIONS LTD., Edmonton (CA)

( * ) Notice: Subject to any disclaimer, the term of this patent is extended or adjusted under 35 U.S.C. 154(b) by 0 days.

(21) Appl. No.: 16/382,610

(22) Filed: Apr. 12, 2019

(65) Prior Publication Data

US 2019/0257167 A1 Aug. 22, 2019

Related U.S. Application Data

(63) Continuation of application No. 15/892,866, filed on Feb. 9, 2018, now abandoned, which is a continuation (Continued)

(51) Int. Cl.
*E21B 28/00* (2006.01)
*E21B 7/04* (2006.01)

(Continued)

(52) U.S. Cl.
CPC ..... *E21B 28/00* (2013.01); *E21B 7/04* (2013.01); *E21B 7/046* (2013.01); *E21B 7/24* (2013.01);

(Continued)

(58) Field of Classification Search
CPC . E21B 17/10; E21B 21/10; E21B 7/04; E21B 7/24; E21B 28/00; E21B 2034/007; E21B 34/14

See application file for complete search history.

(56) References Cited

U.S. PATENT DOCUMENTS 3,557,875 A 1/1971 Solum et al.
4,384,625 A 5/1983 Roper et al.

(Continued)

FOREIGN PATENT DOCUMENTS

CA 2497458 A1 * 3/2004 ..... E21B 21/103
CN 105735929 A 7/2016

(Continued)

OTHER PUBLICATIONS

PCT/CA2016/050794 International Search Report and Written Opinion of the International Searching Authority dated Sep. 9, 2016 (pp. 1-10).

(Continued)

*Primary Examiner* — Jennifer H Gay
(74) *Attorney, Agent, or Firm* — Jenna L. Wilson; Wilson Lue LLP

(57) ABSTRACT

A method of drilling a substantially lateral section of a wellbore includes extension of a first segment of a drilling string with a bottom hole assembly is extended into a wellbore. At determined intervals of the drilling string, a plurality of friction reduction segments are connected as the wellbore is drilled and the drilling string is extended into the wellbore. The friction reduction segments comprise a friction reduction tool and corresponding activation tool for activating the friction reduction tool. The activation tool selectively diverts drilling fluid into a motor powering the friction reduction tool or away from the motor, and can be a ball catch assembly that is activated when a suitably sized projectile is seated in the assembly. Multiple friction reduction segments can be connected to the drilling string and one or more of the plurality of segments can be activated.

19 Claims, 9 Drawing Sheets

Related U.S. Application Data of application No. PCT/CA2016/050794, filed on Jul. 7, 2016.

(60) Provisional application No. 62/205,655, filed on Aug. 14, 2015, provisional application No. 62/207,679, filed on Aug. 20, 2015, provisional application No. 62/220,859, filed on Sep. 18, 2015.

(51) Int. Cl.

| | |
|---|---|
| ***E21B 7/24*** | (2006.01) |
| ***E21B 17/10*** | (2006.01) |
| ***E21B 21/10*** | (2006.01) |
| ***E21B 34/10*** | (2006.01) |
| ***E21B 34/00*** | (2006.01) |

(52) U.S. Cl.

CPC ..... *E21B 17/10* (2013.01); *E21B 21/10* (2013.01); *E21B 34/10* (2013.01); *E21B 2034/007* (2013.01)

(56) References Cited

U.S. PATENT DOCUMENTS

| | | | | |
|---|---|---|---|---|
| 4,890,682 | A | 1/1990 | Worrall et al. | |
| 5,535,835 | A | 7/1996 | Walker | |
| 6,279,670 | B1 | 8/2001 | Eddison et al. | |
| 6,431,294 | B1 | 8/2002 | Eddison et al. | |
| 6,508,317 | B2 | 1/2003 | Eddison et al. | |
| 7,163,058 | B2 * | 1/2007 | Bakke | E21B 31/113 166/301 |
| 7,549,485 | B2 * | 6/2009 | Radford | E21B 10/322 175/57 |
| 7,575,051 | B2 * | 8/2009 | Stoesz | E21B 31/005 166/177.6 |
| 7,708,088 | B2 * | 5/2010 | Allahar | E21B 31/005 175/55 |
| 8,181,719 | B2 * | 5/2012 | Bunney | E21B 4/02 175/107 |
| 8,201,641 | B2 * | 6/2012 | Allahar | E21B 7/24 175/56 |
| 8,636,073 | B2 | 1/2014 | McNeilly | |
| 8,869,916 | B2 * | 10/2014 | Clausen | E21B 7/06 175/61 |
| 9,004,194 | B2 | 4/2015 | Eddison et al. | |
| 9,091,123 | B2 | 7/2015 | Gust | |
| 9,273,529 | B2 * | 3/2016 | Eddison | E21B 7/24 |
| 9,371,692 | B2 | 6/2016 | Eddison | |
| 9,476,263 | B2 * | 10/2016 | Clausen | E21B 7/06 |
| 9,494,006 | B2 * | 11/2016 | Mohon | E21B 7/24 |
| 9,593,537 | B2 * | 3/2017 | Gust | E21B 7/24 |
| 9,879,495 | B2 * | 1/2018 | Baudoin | E21B 28/00 |
| 10,316,588 | B1 * | 6/2019 | Robertson | E21B 7/24 |
| 2002/0157871 | A1 * | 10/2002 | Tulloch | E21B 7/24 175/56 |
| 2004/0045716 | A1 * | 3/2004 | Bakke | E21B 31/113 166/301 |
| 2006/0108152 | A1 * | 5/2006 | Lee | E21B 21/103 175/317 |
| 2006/0237187 | A1 * | 10/2006 | Stoesz | E21B 31/005 166/177.6 |
| 2009/0101328 | A1 | 4/2009 | Leslie et al. | |
| 2009/0266612 | A1 * | 10/2009 | Allahar | E21B 31/005 175/55 |
| 2010/0212901 | A1 | 8/2010 | Buytaert | |
| 2010/0224412 | A1 * | 9/2010 | Allahar | E21B 7/24 175/55 |
| 2010/0276198 | A1 | 11/2010 | Light | |
| 2010/0326733 | A1 | 12/2010 | Anderson | |
| 2011/0073374 | A1 * | 3/2011 | Bunney | E21B 4/02 175/107 |
| 2013/0048386 | A1 * | 2/2013 | Le | E21B 23/14 175/93 |
| 2013/0118812 | A1 * | 5/2013 | Clausen | E21B 7/06 175/267 |
| 2014/0041943 | A1 | 2/2014 | Lanning et al. | |
| 2014/0048283 | A1 * | 2/2014 | Mohon | E21B 28/00 166/374 |
| 2014/0069639 | A1 | 3/2014 | MacKenzie et al. | |
| 2014/0151068 | A1 | 6/2014 | Gilleylen | |
| 2014/0190749 | A1 | 7/2014 | Lorenson | |
| 2014/0199196 | A1 | 7/2014 | Twardowski | |
| 2014/0216761 | A1 | 8/2014 | Trinh | |
| 2014/0246241 | A1 | 9/2014 | Lorenson et al. | |
| 2015/0008043 | A1 * | 1/2015 | Clausen | E21B 7/06 175/57 |
| 2015/0041217 | A1 * | 2/2015 | Gust | E21B 7/24 175/57 |
| 2015/0075867 | A1 * | 3/2015 | Eddison | E21B 7/24 175/56 |
| 2015/0136403 | A1 | 5/2015 | Cheng | |
| 2015/0354307 | A1 * | 12/2015 | Baudoin | E21B 28/00 166/373 |
| 2016/0108677 | A1 | 4/2016 | von Gynz-Rekowski | |
| 2016/0281449 | A1 | 9/2016 | Lorenson et al. | |
| 2017/0204693 | A1 | 7/2017 | von Gynz-Rekowski | |
| 2017/0254179 | A1 * | 9/2017 | Horwell | E21B 34/102 |
| 2018/0156001 | A1 * | 6/2018 | Schwendemann | E21B 31/005 |
| 2018/0163495 | A1 * | 6/2018 | Kinsella | E21B 7/04 |
| 2018/0236580 | A1 * | 8/2018 | Kolbe | E21B 34/06 |
| 2019/0010762 | A1 * | 1/2019 | Rossing | E21B 43/126 |

FOREIGN PATENT DOCUMENTS

| | | | |
|---|---|---|---|
| WO | 2012138383 | A2 | 10/2012 |
| WO | 2014/089618 | A1 | 6/2014 |
| WO | 2015/081432 | A1 | 6/2015 |

OTHER PUBLICATIONS

NOV Wellbore Technologies, "Agitator(TM) Systems", published at least as early as Feb. 2016, 5 pgs.

European Extended Search Report dated May 16, 2019 from EP16836307.5, 11 pgs.

International Preliminary Report on Patentability dated Mar. 1, 2018 from PCT/CA2016/050794, 8 pgs.

* cited by examiner

LATERAL DRILLING METHOD

CROSS-REFERENCE TO RELATED APPLICATIONS

This application is a continuation U.S. patent application Ser. No. 15/892,866 filed on Feb. 9, 2018, which is a continuation of International Application No. PCT/CA2016/050794, filed on Jul. 7, 2016, which claims priority to U.S. Provisional Applications No. 62/205,655, filed on Aug. 14, 2015; 62/207,679, filed on Aug. 20, 2015; and 62/220,859, filed on Sep. 18, 2015, the entireties of all of which are incorporated herein by reference.

TECHNICAL FIELD

The present disclosure relates to drilling horizontal or lateral wellbores, and in particular drilling string assemblies and methods for horizontal or lateral drilling.

TECHNICAL BACKGROUND

It is generally understood that there is a strong correlation between increased lateral length and increased initial production rates in a horizontal well. Accordingly, the development of horizontal well drilling in shale formations has pushed lateral lengths of horizontal wellbores to exceed 10,000 feet, with total measured distances of 20,000 feet.

Limiting factors in drilling lateral sections of horizontal wellbores to even greater distances include rotating and sliding frictional forces between the wellbore and the drilling string, namely resistive torque exerted on the outer surface of the drilling string and hole drag, both due to the drilling bottom hole assembly (BHA) and drill pipe contacting the interior surfaces of the wellbore. While the drill pipe and BHA are rotating to advance the wellbore by drilling, the effect of the rotating and sliding friction is reduced; however, when the wellbore direction needs to be adjusted, the drill pipe and BHA must "slide", no longer rotating while only the drill bit turns. Since there is little or no rotational movement in the drilling string or BHA during the slide, friction may cause difficulty in advancing the bit.

To address such problems, an impulse or vibration tool can be introduced into the drilling string to impart a vibratory motion to the string and potentially the BHA. The inclusion of such prior art tools, however, can create additional challenges while drilling.

BRIEF DESCRIPTION OF THE DRAWINGS

In drawings which illustrate by way of example only embodiments of the present disclosure, in which like reference numerals describe similar items throughout the various figures.

DETAILED DESCRIPTION OF THE INVENTION

Figure 1:
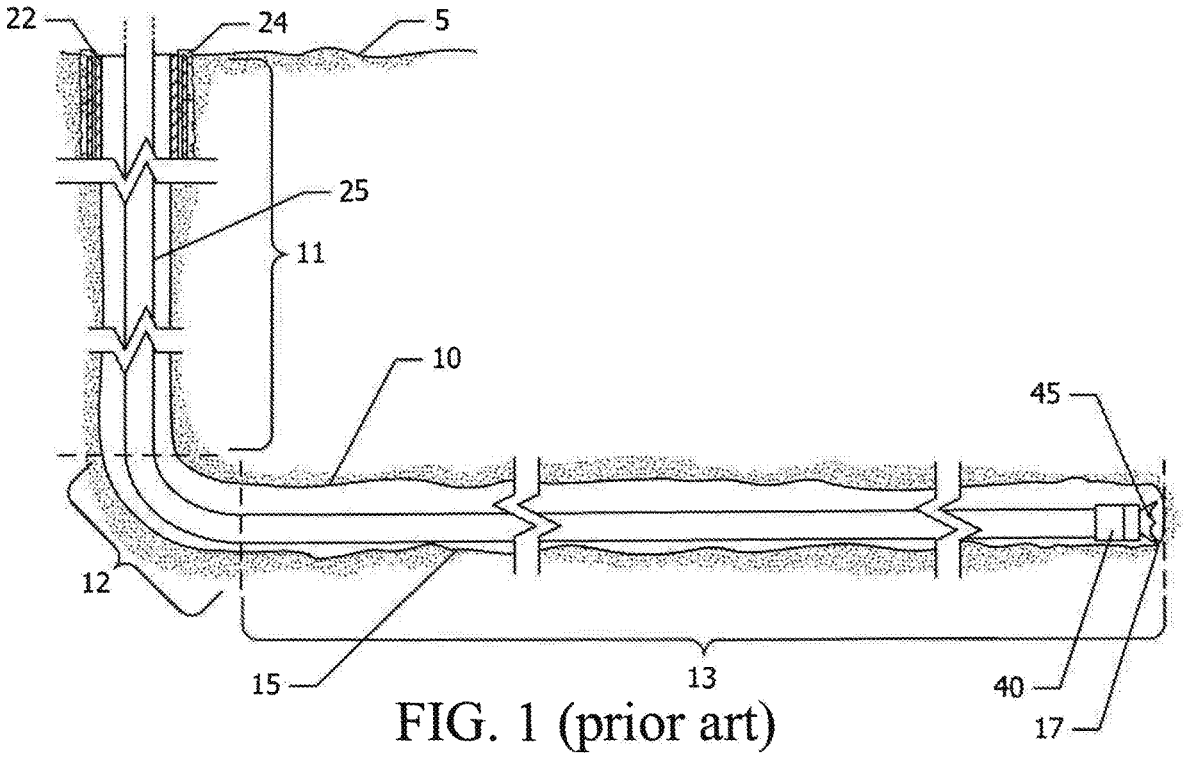
FIG. 1 (prior art)
FIG. 1 is a schematic illustrating an example position of a prior art drilling string in a horizontal well.

The present disclosure is directed to drilling horizontal or lateral wellbores. A prior art directional drilling string assembly 25 in use in a horizontal or lateral wellbore 10 is illustrated in FIG. 1. The wellbore 10 includes a substantially vertical section 11, a build section 12, and a lateral section 13, which in this example is substantially horizontal but may be somewhat inclined. The build section 12 generally indicated in FIG. 1 denotes individual build and tangential portions that transition the wellbore 10 from the substantially vertical section 11 to the lateral section 13. It will be appreciated by those skilled in the art that the accompanying drawings are not drawn to scale in the interest of clarity; a build section 12, for example, may have portions with slower or faster build rates than illustrated here. Further, the drawings represent a cross-sectional view of a wellbore 10, with a single build section 12 providing a transition from the substantially vertical section 11 to the lateral section 13. The wellbore 10 may include multiple build sections transitioning the wellbore from the substantially vertical section 11 to the lateral section 13; for example, after the build section 12 illustrated in the drawings, a further build section (not shown) could transition the wellbore from the bearing direction of the build section 12 to the bearing of the lateral section 13. This further build section could lie in substantially the same plane or depth as the lateral section 13

The top portion of the wellbore 10 is, as is known in the art, generally drilled at a greater diameter than lower portions (i.e., the lower portion of the vertical section 11, the build section 12, and the lateral section 13) to accommodate casing and cement layers isolating permeable formations intersected by the wellbore 10 and preventing fluids from one formation from mixing with fluids from other formations. A representative casing 22 and cement layer 24 is illustrated in the figures. A prior art drilling string 25 extends from the wellhead at the surface 5 and terminates with the BHA 40, which can include typical tools and components such as measurement or logging while drilling (MWD and LWD) tools), thrusters, shock tools, resistivity at the bit (RAB) tools, jarring tools, collars, a drill bit and corresponding motor, and so forth. While the drill bit 45 positioned proximate to the wellbore bottom 17 is shown in the drawings, other typical BHA components are omitted for clarity. Also, for ease of exposition, the typical surface equipment and fittings at the wellhead, such as the drilling rig and surface casing, as well as particular components of drilling strings are omitted from the accompanying figures, but the construction and operation of these conventional features will be understood by those skilled in the art.

When extended through the lateral section 13 of the wellbore 10, portions of the drilling string 25, including the BHA 40, may contact the interior 15 of the wellbore, giving rise to friction between the drilling string 25 and the interior of the wellbore 10. As noted above, this friction resists motion of the drilling string 25 during a slide. To mitigate frictional forces, an impulse or vibrational tool can be introduced. As those skilled in the art will understand, such a tool may be powered by a motor having a rotor and stator, such as a Moineau motor activated by the flow of drilling mud through the drilling string, and can impart a vibrational motion to the drilling string. The motion generated in the drilling string by these tools assists in reducing static friction. Tools used in this manner to reduce friction are referred to as "friction reduction tools" herein. Using friction reduction tools, drilling operators have been able to extend lateral wellbores to lengths on the order of 10,000 feet, as mentioned above.

However, the same prior art friction reduction tools may have characteristics that also reduce drilling efficiency. Many such friction reduction tools are dependent on drilling fluid pressure within the string 25 and effectively cause a pressure drop in the drilling string. As a result, the operator must ensure that there is sufficient fluid pressure at the surface to not only activate the friction reduction tool downhole, but also provide sufficient fluid pressure at the drill bit. It may therefore be undesirable to employ more than one friction reduction tool in a single drilling string 25. This single tool must therefore generate enough vibrational energy to impart motion to a significant section of the drilling string and potentially the BHA, because additional friction reduction tools in the string 25 are not feasible. On the other hand, when a tool generating such levels of kinetic energy is placed too near the drill bit 45, the vibrations and/or pressure pulses generated during operation of the prior art friction reduction tool may interfere with MWD instruments in the BHA. As a result, it may be necessary to place the friction reduction tool at a point further away from the BHA; the trade-off, however, is that this reduces the vibrational effect at the BHA when a vibrational effect at the BHA may be desirable.

Furthermore, many prior art friction reduction tools, which are driven by drilling fluid flow, operate in an "always on" manner: if drilling fluid is flowing, the friction reduction tool will generate vibrations in the drilling string. This is inconvenient, and potentially damaging, if the drilling circulation pump controlling drilling fluid flow needs to be activated when the friction reduction tool is not in the correct position in the wellbore, or operation of the friction reduction tool is not desired. For instance, if the friction reduction tool is located within the casing 22 when the drilling circulation pump is turned on and the motor powering the tool is activated, the vibrating drilling string 25 may potentially damage the cement 24 or casing 23. To avoid such potential harm to the cement or casing the friction reduction tool may be omitted from the drilling string 25 during initial drilling; when it is determined that the friction in the wellbore is preventing or limiting further progress, the drilling string 30 is retracted to the surface, disassembled and reassembled with a friction reduction tool, then lowered back into the wellbore to continue drilling. Such a procedure consumes additional time and resources.

Another procedure in the prior art drilling of horizontal wells may also cause delays and added expense. As is understood by those skilled in the art, maintaining weight transfer to the drill bit 45 is problematic when drilling a lateral section 13. In a vertical drilling operation, gravity assists in pulling the BHA downward; under the control of the drilling rig, sufficient weight can be applied to the bit 45 to drill through formations. On the other hand, when drilling a lateral section 13, gravity acting on the lateral section pipe is of less assistance in weight transfer. Instead, heavy weight drill pipe (HWDP) is added to the drilling string 30 at the upper portion of the build section 12; its extra weight under the influence of gravity "pushes down" on the lower portion of the drilling string 25 in the lateral section 13. Once the HWDP portion of the string 25 reaches the bottom of the build section 12, it is preferable to retract the string 25, disassemble the portion of the string 25 with the HWDP, and reassemble the string 25 so that the HWDP is again located at the upper portion of the build section 12. This procedure must be repeated each time the HWDP reaches the bottom of the build section 12, since permitting the HWDP to enter the lateral section 13 may compound the frictional forces already retarding advancement of lateral drilling.

Figure 2:
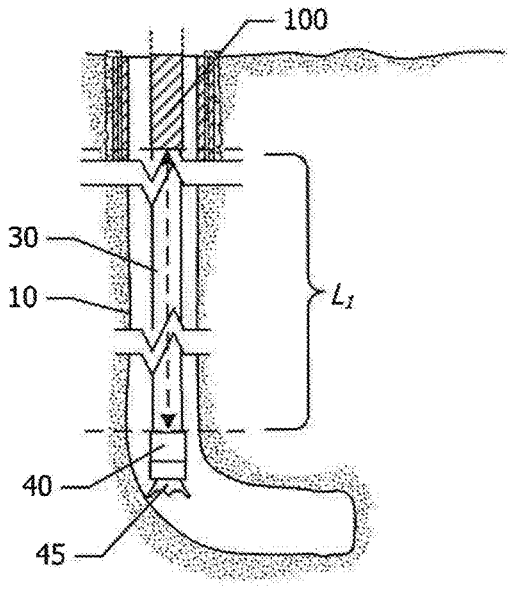
FIG. 2 is a schematic illustrating a drilling string including a friction reduction tool and activation tool in an example embodiment.

Accordingly, an improved process for lateral wellbore drilling, using an improved drilling string assembly 30 with selectively actuatable friction reduction tools, is provided. This improved process mitigates the inefficiencies and trade-offs mentioned above. FIG. 2 illustrates the improved drilling string assembly 30 at an initial stage in the improved process. Initially, the vertical section 11 and build section 12 are drilled; this may be done in the conventional manner. The casings 22 and cement 24 in the vertical section 11 are also completed in the conventional manner. The drilling string assembly 30 for use in the lateral section 13 of the wellbore 10, including the lateral BHA 40 comprising the drill bit 45, is assembled. A first segment of the drilling string assembly 30 will include the BHA. Standard drill pipe is attached to the first segment including the BHA.

The drilling string assembly 30 is lowered into the wellbore. At a first distance indicated in FIG. 3 as $L_1$, a first activation tool and corresponding first friction reduction tool are added to the string assembly 30. In the accompanying drawings, friction reduction and activation tools are provided in a combination assembly 100, described in further detail below. The first distance $L_1$ can be selected based on various operational factors determined by the characteristics and components of the drilling string assembly 30, the characteristics of the formation through which the wellbore is drilled, or both. For example, the distance $L_1$ can be determined at least in part based on an expected preferred distance between the friction reduction tool and MWD tools at the BHA or other BHA components. This expected preferred distance may be determined using the expected kinetic output of the friction reduction tool, optionally in view of the weight of the assembly 30 in various sections of the wellbore, the structure of the wellbore 10 (e.g., the length of the vertical, lateral, and build sections, as well as the number of build sections) and/or the characteristics of the formation through which the wellbore sections are drilled. For example, it may be desirable to have a friction reduction tool as close to the BHA as possible without generating interference impacting MWD instruments. Alternatively, based on the characteristics of the other components of the assembly 30 or the formation, it may be expected that a friction reduction tool may be positioned at another location further back relative to the BHA. The first distance $L_1$ is selected accordingly.

In the illustrated embodiments, the components of the friction reduction tool and activation tool are arranged such that they may be considered to be a combination assembly 100. The combination assembly may be a single sub that can be physically assembled in the drilling string assembly 30 as a single unit between lengths of drill pipe, but practically it may be desirable to be able to disassemble the combination assembly 100 to access specific components, such as the activation tool portion. Thus, the combination assembly 100 may be assembled as various sections making up the friction reduction tool and activation tool are added to the drilling string assembly 30. The combination assembly 100 illustrated in FIG. 6A comprises such a series of friction reduction tool and activation tool components that can be added serially to the drilling string assembly. The examples illustrated and described herein should not be considered as limiting to the inventive concepts described herein unless expressly indicated as limiting; references to a drilling string assembly 30 comprising both an activation tool and a friction reduction tool are intended to include all possible variations unless otherwise indicated.

Figure 3:
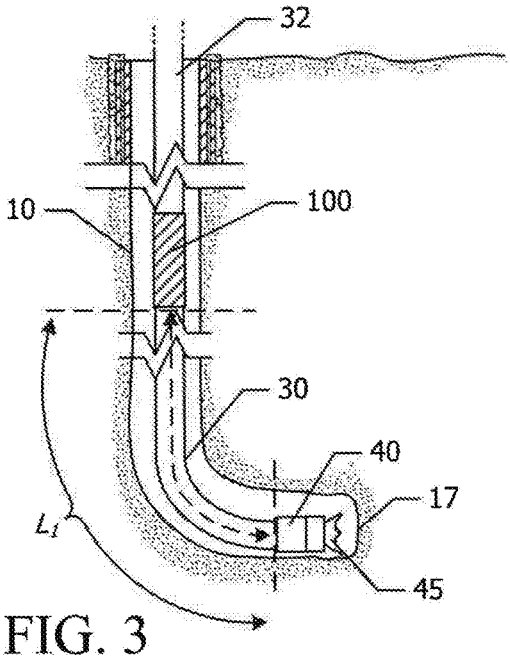
FIG. 3 is a schematic of the drilling string of FIG. 2 after commencement of lateral drilling.

Once the first friction reduction tool and activation tool are installed in the drilling string assembly 30, the drilling string assembly 30 with the lateral BHA is lowered to the bottom 17 of the wellbore. It will be appreciated, of course, that if there is no need to bring the assembly 30 to surface to make modifications to the components at the BHA (for example) after the vertical and/or build sections are drilled, the friction reduction and activation tools may be added to the drilling string assembly 30 at $L_1$ without raising the rest of the assembly 30 to the surface. Additional drill pipe 32 and optionally other drilling string components are added above the friction reduction and activation tools as shown in FIG. 3.

Figure 4:
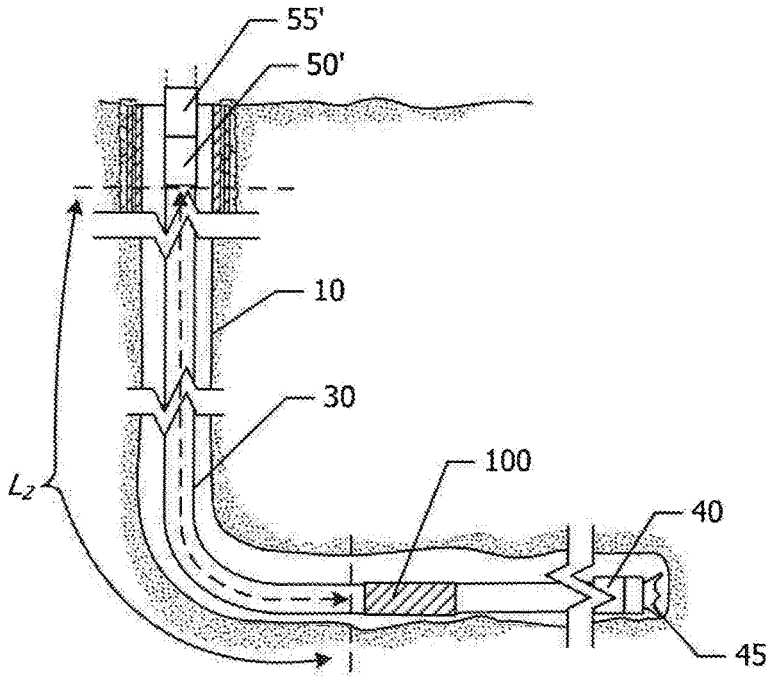
FIG. 4 is a schematic of the drilling string of FIG. 2 in a later stage of lateral drilling with a second friction reduction tool and activation tool.
Figure 5:
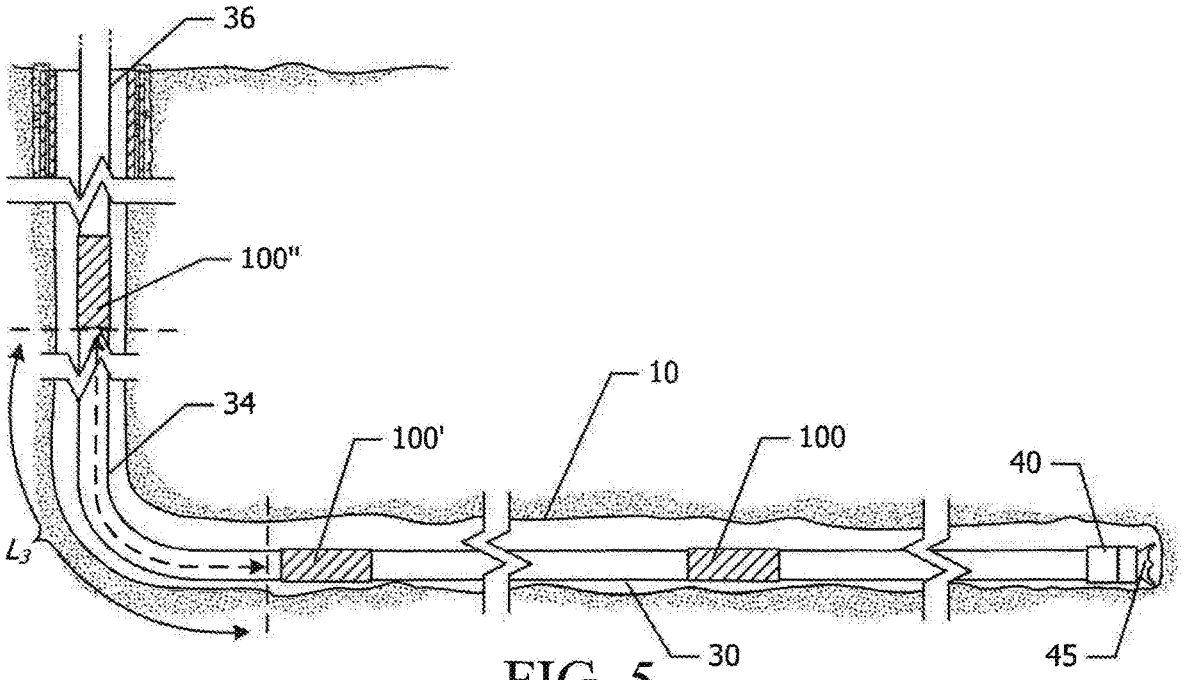
FIG. 5 is a schematic of the drilling string of FIG. 4 in still a later stage of lateral drilling, with a further friction reduction tool and activation tool.

After further drilling, a second friction reduction tool and second corresponding activation tool is added at a second position $L_2$ along the drilling string assembly 30, as shown by the position of the second combination assembly 100' in FIG. 4. $L_2$ may also be determined based on the characteristics of the drilling string assembly 30 and its components, and/or the characteristics of the wellbore or formation, as discussed above. For example, it has been found that in wellbores with multiple build sections, it would be useful to have a drilling string assembly 30 with a first friction reduction tool positioned at or about the midsection of the lateral section 13 and a second friction reduction tool positioned at or about the top of the first vertical to horizontal build section. In this way, as the second friction reduction tool advances through the build sections, it assists in friction reduction and weight transfer of the drill string around the bend created by the second build section. The second position $L_2$ may thus be determined in part by the length of build sections. Additional drill pipe and other optional drilling string components are then added above the second friction reduction and activation tools (or combination assembly 100'). Optionally, this process can be repeated one or more further times to add one or more friction reduction tool-activation tool combinations. There may thus be three, four, or more friction reduction tools included in the drilling string assembly 30. FIG. 5 illustrates one example implementation, in which a third combination assembly 100" comprising third friction reduction and activation tools has been added, with additional drill pipe sections 34 and 36, after further drilling, as illustrated in FIG. 5.

Figure 6A:
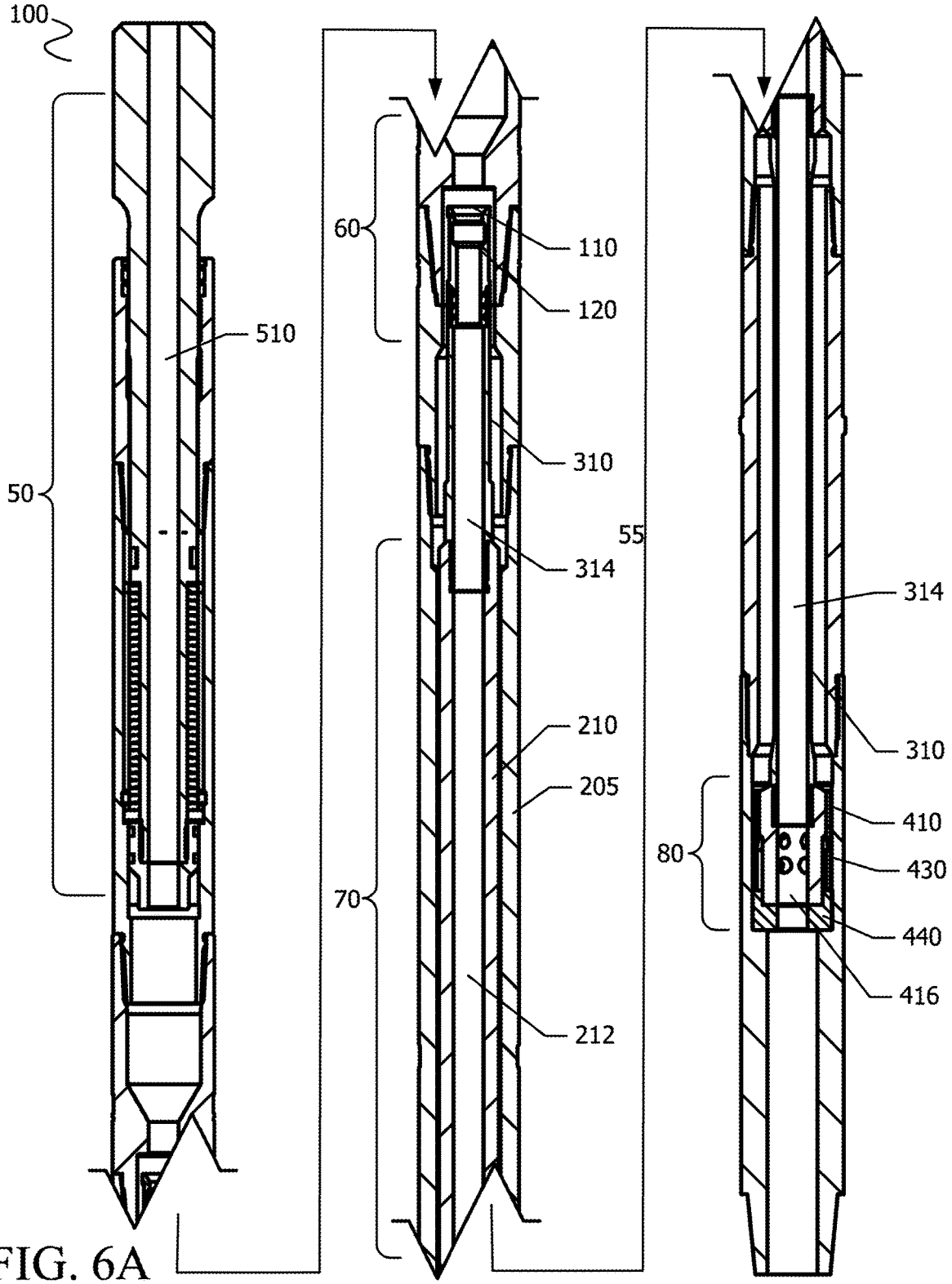
FIG. 6A is a cross-sectional view of an example combination assembly comprising a friction reduction tool and activation tool.
Figure 6B:
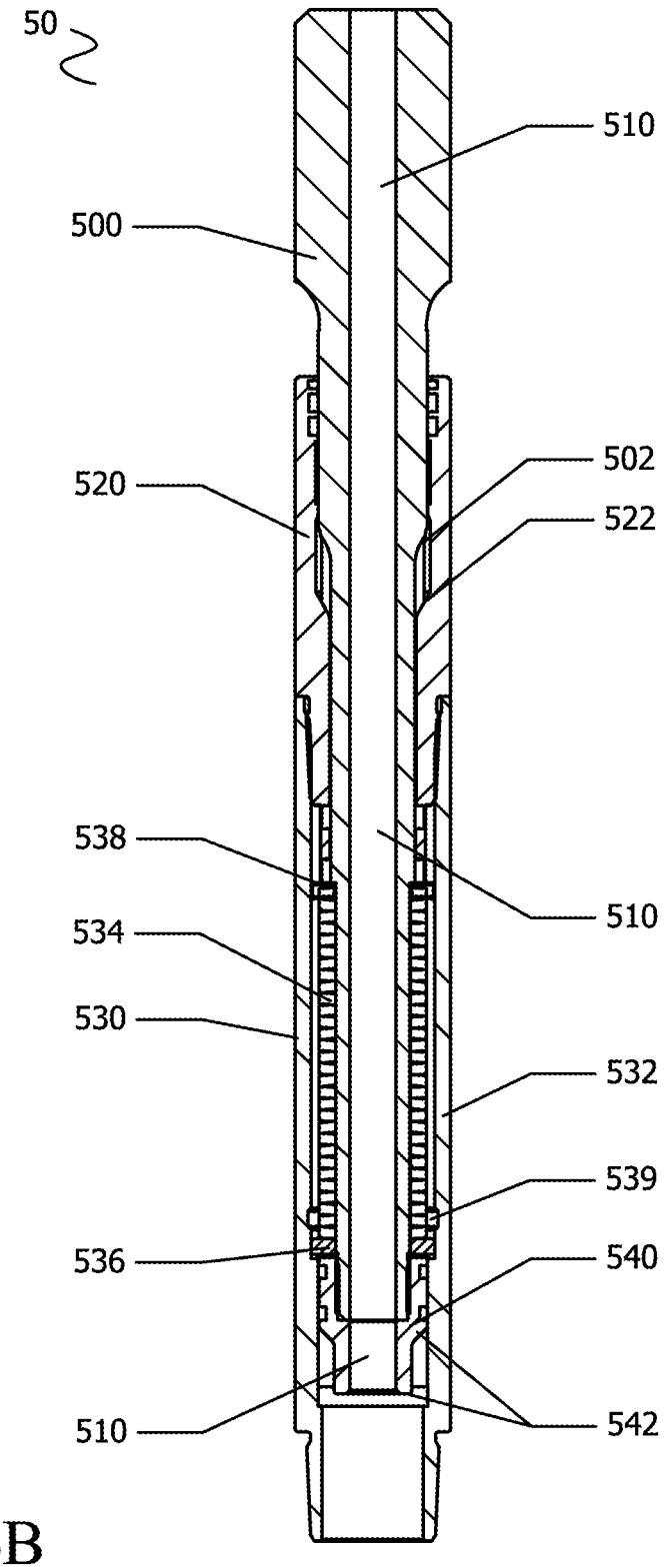
FIG. 6B is a cross-sectional view of an example oscillating assembly component of a friction reduction tool.

FIG. 6A illustrates an example combination assembly 100 comprising particular examples of an activation tool and a friction reduction tool. As indicated in FIG. 6A, this example combination assembly 100 includes, from the top down, an oscillation unit 50, the activation tool 60, a motor section 70, and a pulsing unit 80. These components 50, 60, 70, 80 include appropriate housings that can be connected (e.g., by threaded connections) to other components, such as drill pipe, of the drilling string assembly 30. Further, these components may be directly connected to one another, or else spaced apart by connector units that provide the required fluid communication between the various units and motor. In FIG. 6A, such connections are provided by flow-through drive shafts 310 and corresponding housings. The activation tool 60 in this example assembly 100 is a ball catch assembly. Examples of a ball catch assembly are illustrated in FIGS. 7A to 8B. The friction reduction tool comprises at least the oscillation unit 50 and the pulsing unit 80. The oscillating unit 50 may be supplied by a conventional shock tool, or another vibration or jarring tool (which need not "oscillate" within set amplitudes or with a defined period). An example oscillating unit 50 is illustrated in FIG. 6B. The pulsing unit 80, in the illustrated examples, is a rotating variable choke assembly, but other suitable means for inducing drilling fluid pressure variations or flow rate variations may be employed in place of the variable choke assembly. An example variable choke assembly is illustrated in FIGS. 9A to 11B. The motor section comprises a Moineau-type motor. In this example, the rotor/stator lobe ratio may be 7/8.

In this example, the pulsing unit 80 is activated by rotation of the rotor 210 in the motor section 70; the pressure variations it produces activate the oscillation unit 50 to produce axial vibration. Thus, either the activation tool 60 or the friction reduction tool can notionally be considered as including the motor section 70, since the activation of the motor results in activation of the friction reduction tool; or else the motor section 70 can be considered as a separate portion within the friction reduction tool-activation tool assembly 100. Those skilled in the art will appreciate that the inventive concepts described herein are not reliant on the theoretical allocation of the motor section as belonging to one tool or the other. It will further be appreciated that the connection of a friction reduction tool with an activation tool such that they are in operable communication with one another so that the activation tool can activate the friction reduction tool would be accomplished by the activation tool activating a motor that powers a pulsing unit to create the drilling fluid pressure variations needed to drive the oscillating unit.

In the example of FIG. 6A, the combination assembly 100 provides dual routes for passage of drilling fluid. Briefly, a first route permits for passage of substantially all the drilling fluid through the combination assembly 100 with relatively constant fluid pressure and without activating the friction reduction tool (subject to other components of the drilling string assembly 30 incidentally inducing pressure changes in the fluid). A second route is created by activation of the ball catch assembly, which diverts fluid to activate the motor and thereby drive the rotating variable choke assembly. While the drilling fluid still passes through the combination assembly 100 to the downhole components in the drilling string assembly 30, the rotation of the variable choke assembly induces changes in fluid pressure at the friction reduction tool, thus activating the friction reduction tool and creating vibratory motion in the drilling string assembly 30.

An example oscillation unit 50 is shown in FIG. 6B. The oscillation unit 50 comprises a mandrel 500 engaged in an splined housing 520 and compression assembly 530 such that the mandrel 500 can move up and down axially with respect to the housing 520 and assembly 530. A limit of travel is defined by a shoulder 502 provided on the mandrel 500, which contacts a corresponding internal shoulder 522 of the adaptor housing 520 to limit downward travel of the mandrel 500. The compression assembly 530 comprises a housing 532 containing a spring assembly 534 (e.g., a set of Belleville springs arranged either in series or in parallel, optionally including Belleville springs of different sizes) extending between retainers 536, 538. A piston 540 is mounted to the end of the mandrel 500 below the spring assembly 534 and lower retainer 536. A bore 510 extends through the mandrel and the entire oscillation unit 50, thus permitting fluid communication through the entire tool 50. The oscillation unit 50 operates to convert changes in fluid pressure to axial motion. When the oscillation unit 50 is actuated by a change in pressure below the piston 540, normal forces on the surfaces 542 of the piston 540 caused by fluid pressure causes the piston 540 and mandrel 500 to move upwards against the lower retainer 536 and compress the spring assembly 534. Movement of the mandrel 500 is limited by a stop 539 positioned above the lower retainer 536. When the pressure below the piston 540 drops, the spring assembly 534 expands, causing the piston 540 and mandrel 500 to move in the opposite direction. Pressure variations induced in the fluid below the piston 540 thus induce axial vibrational motion in the oscillation unit 50, which assists in reducing friction as discussed above.

Returning to FIG. 6A, the activation tool 60 is positioned below the oscillation unit 50. In this example, the activation tool 60 comprises a ball catch assembly having a ball catch head 110 shaped to receive a projectile (e.g., ball made of a suitable material, such as stainless steel or Teflon) falling from above, and to direct the projectile to a ball seat 120 which is dimensioned to retain the projectile in place. Depending on whether the ball catch assembly is unengaged (i.e., no projectile in place) or engaged (i.e., a projectile in place on the ball seat 120), drilling fluid entering the ball catch assembly from above either passes through a central bore the ball catch assembly, or around the outside of the ball catch assembly.

Figure 7A:
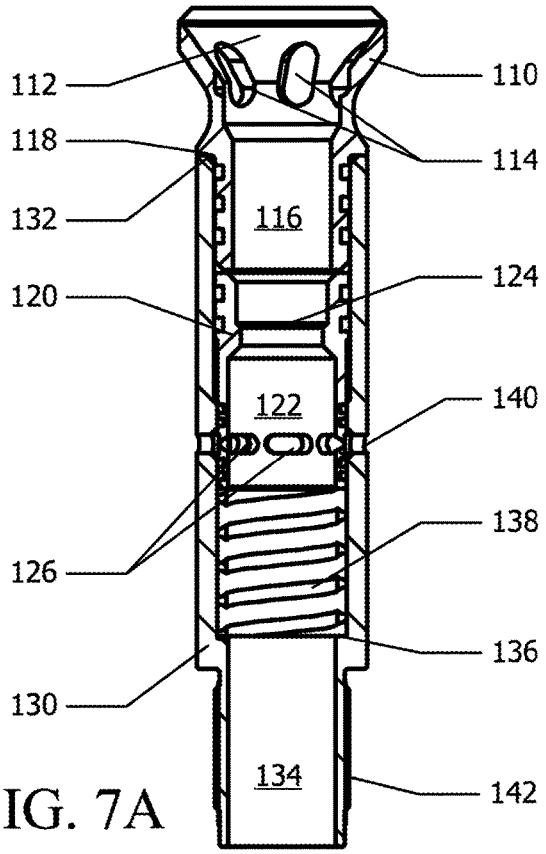
FIGS. 7A and 7B are cross-sectional views of an example ball catch assembly of the combination assembly depicted in FIG. 6A in a non-engaged and an engaged state.
Figure 7B:
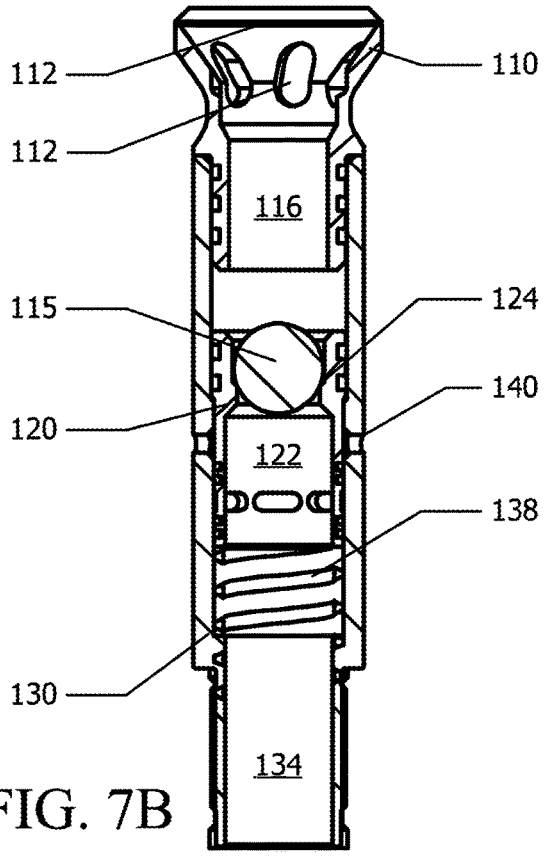

One example ball catch assembly is illustrated in FIGS. 7A and 7B. This assembly comprises a ball catch head 110, a ball catch seat 120, and a ball catch retainer 130. Each of these components is provided with a through bore 116, 122, 134. A spring 138 or other biasing means is mounted on an interior shoulder 136 defined in a lower portion of the ball catch retainer 130, within the bore 134. A set of one or more bypass ports 140 may be provided in a wall of the ball catch retainer 130 above the interior shoulder 136, to permit passage of fluid between the interior and exterior of the retainer 130. An upper face 132 of the ball catch retainer 130 supports the ball catch head 110. The ball catch head 110 includes a funnel-like opening 112 sized to receive and direct a ball towards the lower, substantially cylindrical portion of the ball catch head 110. The wall of the funnel-like opening 112 is provided with the one or more bypass ports 114 that permit passage of fluid from the interior of the ball catch head 110 to its exterior. The funnel-like opening 112 is in fluid communication with the bore 116. In the example of FIGS. 7A and 7B, the exterior of the ball catch head 110 includes a circumferential flange component 118 that rests on the upper face 132 of the ball catch retainer 130.

The ball catch seat 120 is supported within the interior of the ball catch retainer 130, below the ball catch head 110. A lower face of the ball catch seat 120 rests on the spring 138, and is able to reciprocate up and down within the ball catch retainer 130 as the degree of compression in the spring 138 changes under the force of drilling fluid flow when a ball 115, as shown in FIG. 7B, is received on the ball catch seat 120. The ball catch seat 120 is a substantially cylindrical component having a through bore 122 in fluid communication with the bore 134 of the ball catch retainer 130 and the bore 116 of the ball catch head 110, and having a varying interior diameter or surface designed to catch a ball received from the ball catch head 110. The ball catch seat 120 includes an interior shoulder or projection 124. This interior shoulder defines a region of reduced interior bore diameter in the seat 120, and is sized to retain an appropriately sized dropped ball in place and prevent its passage further downward.

When the ball catch assembly is not engaged, fluid entering the ball catch assembly can pass through the ball catch head 110, the bores 116, 122, and 134 and into other components of the drilling string assembly 30 below the ball catch assembly. Some fluid may pass through the bypass ports 114 and around the exterior of the ball catch assembly, but most fluid is expected to pass through the head 110 and bores. Thus, fluid entering the ball catch head 110 from above can pass down through the bore 116, or through the bypass ports 114 and thus pass over the outside of the ball catch head 110 and the ball catch retainer 130. When the ball catch assembly is engaged, a projectile such as the ball 115 blocks passage of fluid at the ball catch seat 120; therefore, fluid entering the ball catch assembly will flow through the ports 114 and down around the exterior of the ball catch head 110 and retainer.

Figure 8A:
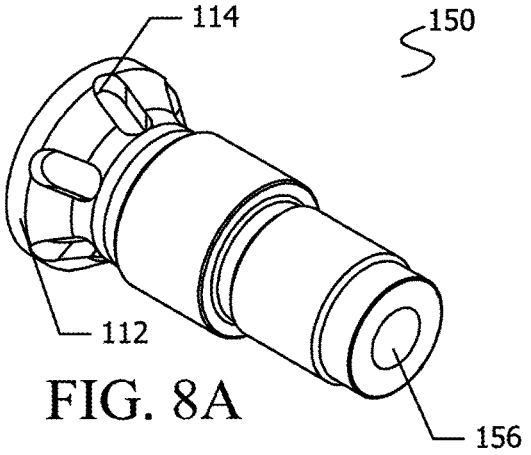
FIGS. 8A and 8B are perspective views and cross-sectional views, respectively, of another example of a ball catch.
Figure 8B:
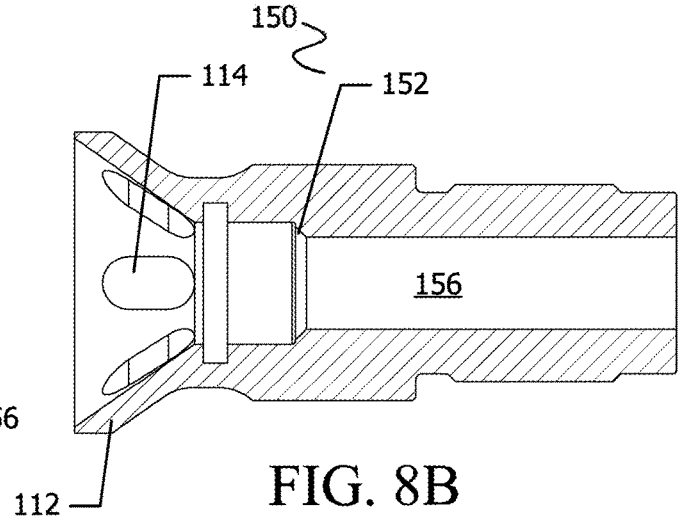

A simpler example of a ball catch tool 150 that may be used as an activation unit in the activation tool 55 is shown in FIGS. 8A and 8B. This ball catch tool 150 is formed as a unitary piece in contrast to the multi-part ball catch assembly illustrated in FIGS. 7A and 7B. The ball catch tool 150 again includes a funnel-like opening 112 with at least one port 114. The opening 112 leads to the bore 156 provided through the body of the ball catch tool 150. As shown in FIG. 8B, an interior shoulder or seat 152 defining a region of reduced interior bore diameter is provided within the bore. The interior shoulder 152 is sized to receive a projectile such as a ball (not shown in FIG. 8B), similar to the ball 115 in FIG. 7B. When an appropriately sized projectile is received and seated in place on the interior shoulder 152 (i.e., when the ball catch tool 150 is engaged), fluid flow through the bore 156 is effectively blocked, and fluid entering the ball catch tool 150 will instead exit the tool 150 through the ports 114 or upper edge of the opening 112.

It will be appreciated by those skilled in the art that the activation tool 60 can comprise variations of the ball catch assembly or tool illustrated in the drawings. For example, rather than a ball, the blocking projectile may be a dart or plug-shaped projectile with a tapered or rounded leading end (i.e., the end facing downwards when the projectile is dropped into the drilling string assembly 30). Accordingly, the shoulder or seat within the activation tool 60 would be shaped to easily capture the projectile and facilitate a sufficiently tight seal (optionally including rubber seals) to prevent significant leakage of drilling fluid past the seated projectile.

Returning again to FIG. 6A, a motor section 70 comprising a rotor 210 and a stator 205 is provided below the ball catch assembly. As will be understood by those skilled in the art, the stator 205 and rotor 210 in a Moineau-type motor are provided with helical contours that cooperate to define cavities between the rotor and stator, which receive fluid entering the motor (in this example, from above) that causes the rotor 210 to turn. The contours of the rotor 210 and stator 205 are not illustrated in FIG. 6A for clarity. As shown in the figure, the rotor 210 is provided with a central bore 212 extending through its entire length; this bore 212 permits drilling fluid to pass through, instead of around, the rotor 212. The central bore of the ball catch assembly or ball catch tool is in fluid communication with the central bore 212 of the rotor 210, and the exterior of the ball catch assembly is in fluid communication with the exterior of the rotor 210. Thus, when the ball catch assembly is not engaged, most drilling fluid entering the ball catch assembly will pass through the rotor bore 212; when the ball catch assembly is engaged, fluid is diverted around the outside of the ball catch assembly and the rotor 210, and will therefore enter a cavity defined by the cooperating contours of the rotor 210 and stator 205. It may be noted that in the example of FIG. 6A, the ball catch assembly and the rotor 210 are not directly connected; in this example, a flow-through drive shaft 310 having a through bore 314 is connected to each of the ball catch assembly and the rotor 210. The bore 314 provides for fluid communication between the bore of the ball catch assembly and the bore 212 of the rotor 210. When fluid passes over the exterior of the ball catch assembly 130, it also passes over the exterior of the drive shaft 310 and down to the exterior of the rotor 210. The drive shaft 310 provides additional connection points in the combination assembly 100. This facilitates dismantling the assembly 100 when it is brought to the surface, for example to retrieve a projectile seated on the ball catch seat 120.

The lower end of the rotor 210 is connected in turn to the pulsing unit 80, which induces variations in pressure when activated by the action of the rotor 210. In this example, the pulsing unit 80 comprises a variable choke assembly comprising a rotating component 410 that is capable of rotating inside a stationary ring component 430. The rotating component is supported by a bearing 440. The rotating component 410 is provided with a bore 416 that permits passage of drilling fluid through the rotating component 410 and down through the bearing 440 and to other components of the drilling string assembly 30 below. The bore 416 is in fluid communication with the bore 212 of the rotor 210, while the upper exterior portion of the rotating component 410 is in fluid communication with the exterior of the rotor 210. Again, it may be noted that the fluid communication is achieved using a second flow-through drive shaft 310 with a through bore 314; the drive shaft 310 connects the rotor 210 at one end with the rotating component 410 at its lower end. This drive shaft 310 thus transmits torque generated by the rotor 210 to the rotating component 410. Rotation of the rotating component 410 varies the rate of fluid flow through the variable choke assembly.

Figure 9D:
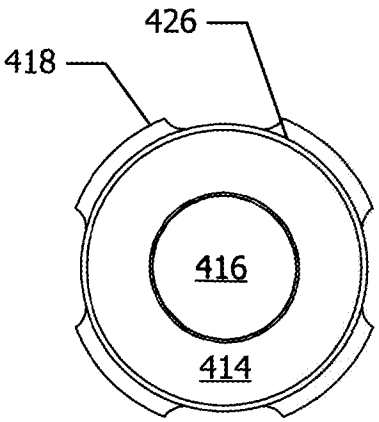
FIGS. 9A, 9B, 9C, and 9D are side, lateral cross-sectional, top, and bottom views, respectively, of an example rotary component in a variable choke assembly in the example combination assembly of FIG. 6A.
Figure 9A:
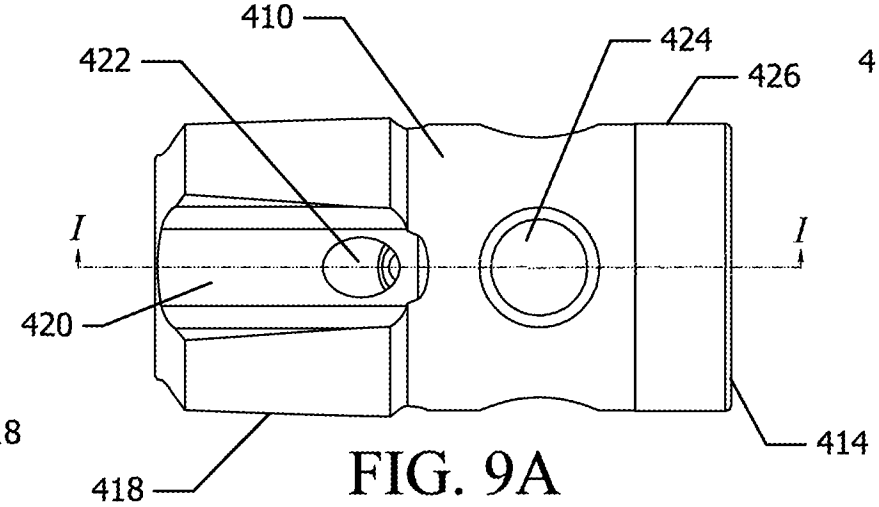
Figure 9B:
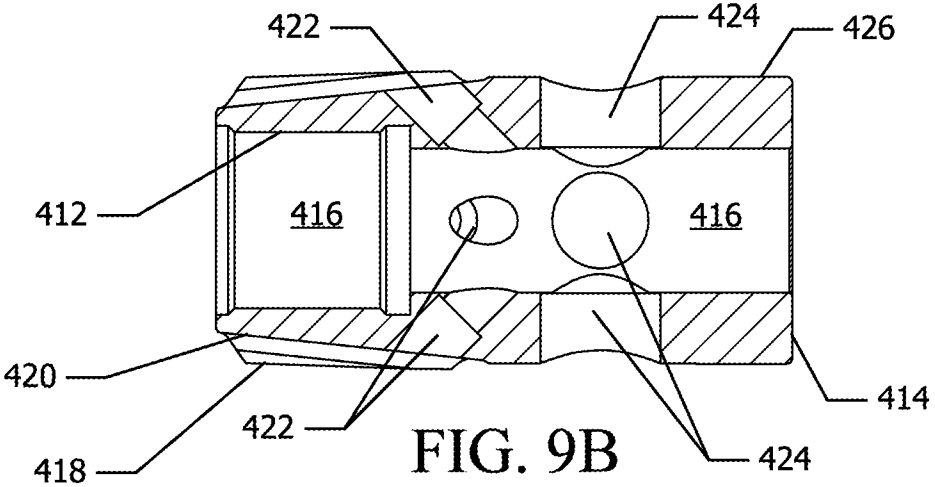
Figure 9C:
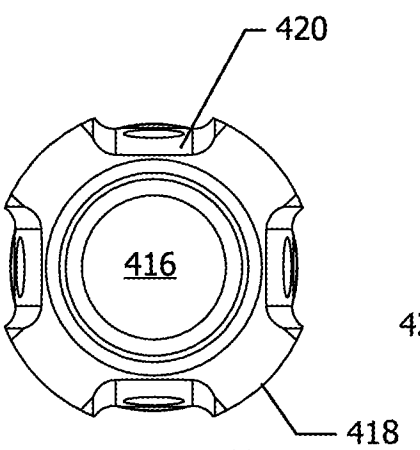

The rotary component 410 is described in further detail in FIGS. 9A to 9D. FIG. 9A illustrates a side elevational view of the rotary component 410, while FIG. 9B provides a view of the cross-section of the view of FIG. 9A taken along plane I-I, and FIGS. 9C and 9D illustrate top and bottom view of the rotary component 410, respectively. The rotary component 410 in this particular example is substantially cylindrical or bullet-shaped, with a slightly tapered upper portion. The body of the rotary component 410 includes a bore 416 extending from the bottom to the top of the component 410, thus providing for fluid flow straight through the body as well as a passage for projectiles sized to pass through the friction reduction tool on its way to a downhole activation tool. The projectiles corresponding to each activation tool 60 of combination assemblies 100, 100', 100", etc. in a drilling string assembly 30 can be of increasing size, where the smallest projectile corresponds to the first activation tool in the first combination assembly 100 closest to the BHA. Therefore, in one example implementation, the bores 416 of each friction reduction tool may have substantially the same interior diameter, while the activation tools are provided with different dimensions of interior shoulders 124 for receiving correspondingly-sized projectiles. The activation tools 60 could then be ordered within the drilling string assembly 30 so that the smallest size projectile and corresponding activation tool 60 is added to the assembly 30 first, the next smallest projectile and corresponding activation tool 60 second, and so on.

The rotary component 410 also includes at least one bypass port 422 and at least one flow port 424, which provide for fluid communication between an exterior of the rotary component 410 and the bore 416. As can be best seen in FIGS. 9A and 9B, the outlets of the bypass ports 422 on the exterior surface of the component 410 are disposed within recessed facets 420 of the rotary component's exterior. These facets originate at a midsection of the component 410 and extend towards the top of the component 410 at an incline, such that they are angled towards the centre of the body (i.e., towards the bore 416) at towards the top of the component 410. This provides a slightly tapered profile to the generally cylindrical shape of the component 410, such that the circumference or perimeter at the top of the component 410 is smaller than at a point around the midsection of the component 410.

The flow ports 424 are provided at or around the midsection of the rotary component 410, and are generally laterally aligned with the bypass ports 422; as can be seen in the illustrated examples, the flow ports 424 are located directly below the bypass ports 422. Drilling fluid flow to the bypass ports 422 and flow ports 424 from above the rotary component 410 (as described below) can be enhanced by further angling or tapering of the upper portion of the component 422; for example, the remaining upper exterior surfaces 418 of the component 410 are likewise angled towards the top of the component 410, as can be seen in FIGS. 9A and 9B.

Figure 10A:
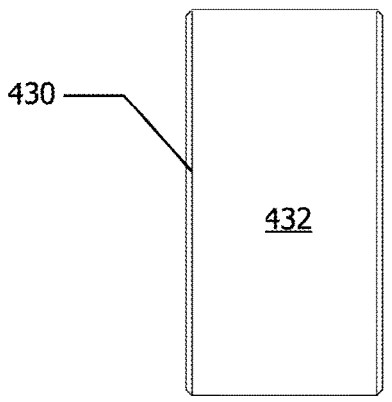
FIGS. 10A and 10B are side and bottom views, respectively, of a stationary ring component of the variable choke assembly.
Figure 10B:
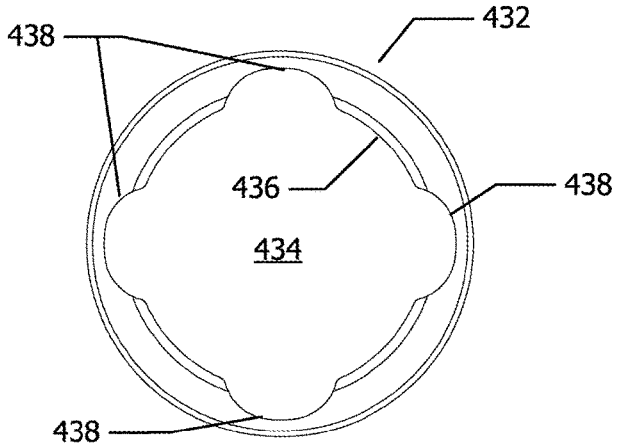

FIGS. 10A and 10B illustrate the stationary ring component 430. The stationary ring component 430 comprises a substantially annular component sized to fit within the housing of the combination assembly 100, and to receive the rotary component 410 within the stationary ring component bore 434. The interior face 436 of the stationary ring component 430 provides the bore 434 with a substantially cylindrical configuration, with one or more channels 438 creating regions of increased bore diameter. The diameter of the bore 434 is sized to fit the rotary component 410 and to permit fluid access to the flow ports 424 of the rotary component 410 when the flow ports 424 are at least partially coincident with corresponding recesses 438, and to substantially block fluid access when the channels 438 are not coincident with the ports 424, as shown in further detail with reference to FIGS. 11A and 11B.

Figure 11A:
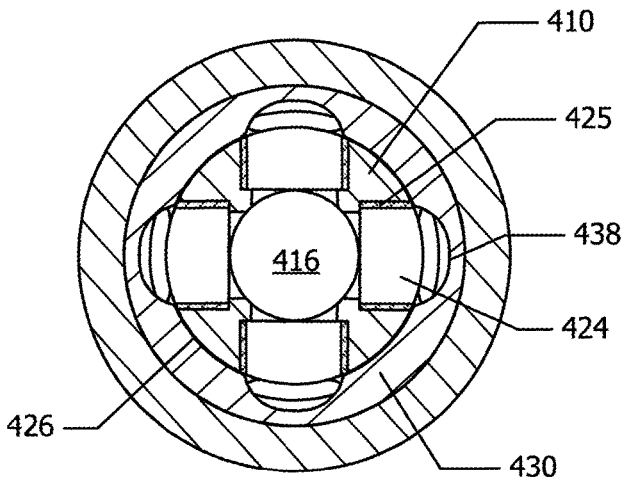
FIGS. 11A and 11B are cross-sectional views of the rotary and stationary ring components of FIGS. 9A to 10B within a drilling string in "open" and "closed" positions.
Figure 11B:
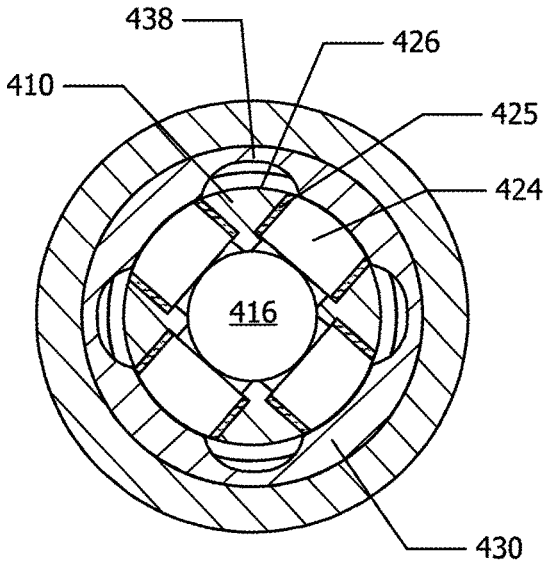

FIGS. 11A and 11B are cross sectional views taken perpendicularly to the axis of the variable choke assembly showing the variable choke assembly in an "open" and "choked" position, respectively. The rotary component 410 can enter into and out of these positions as it rotates inside the stationary ring component 310 while driven by the rotor 210; when the rotor 210 is not active, the rotary component 410 may be positioned in the "open" position, the "choked" position, or an intermediate position. The stationary ring component 430 surrounds the lower portion of the rotary component 410 including the flow ports 424; the bypass ports 422 are positioned above the stationary component 430. In the "open" position, as shown in FIG. 11A, the flow ports 424 are substantially aligned with the channels 438 in the stationary component 410; thus, fluid can enter into the channels 438 and thence into the flow ports 424 and the bore 416. In a partially "open" position, the flow ports 424 are only partially aligned with the channels 438, so less fluid can enter the channels 438 and the flow ports 424. The bypass ports 422, which are not shown in FIG. 11A or 11B, remain open because the outlets of the ports 422 are disposed on a recessed portion of the rotary component 410 above the stationary component 430. The flow rate through the flow ports 424 can be adjusted by altering the interior dimensions and distribution of the flow ports 424 around the rotary component 410, and/or by altering the dimensions of the recesses 438 in the stationary component 430. For example, as illustrated in FIG. 11B, the interior dimensions of the flow ports 424 can be reduced with an optional lining, such as a carbide insert 425.

In the "choked" position, as shown in FIG. 11B, the outlets of the flow ports 424 are substantially blocked because the interior face 436 of the stationary component 430 contacts the exterior of the rotary component 410 above the flow ports 424, thereby cutting off fluid access to the flow ports 424. However, even in the "choked" state, the bypass ports 422 (not shown in FIG. 11A or 11B) will still remain unblocked since the outlets of those ports 422 are disposed on a recessed upper portion of the rotary component 410, as discussed above. In addition, regardless whether the variable choke assembly is in the "choked" or "open" state, the bore 416 still permits passage of drilling fluid, drilling string instruments, and blocking projectiles to the downhole portions of the drilling string assembly 30 (assuming that the corresponding activation tool 60 is not engaged and blocking through passage), even when the particular oscillation unit 50 is active and the rotary component 410 is rotating.

Figure 12:
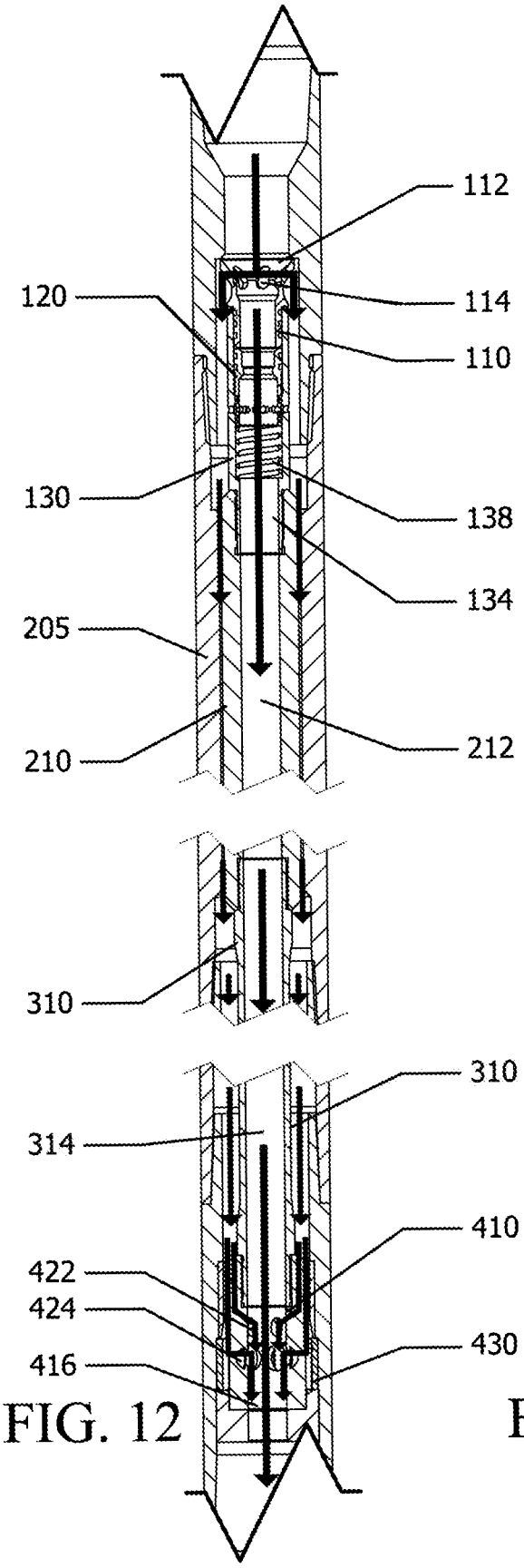
FIGS. 12 and 13 are cross-sectional views of the ball catch assembly and variable choke assembly similar to those shown in the combination assembly of FIG. 6A in non-engaged and engaged states.
Figure 13:
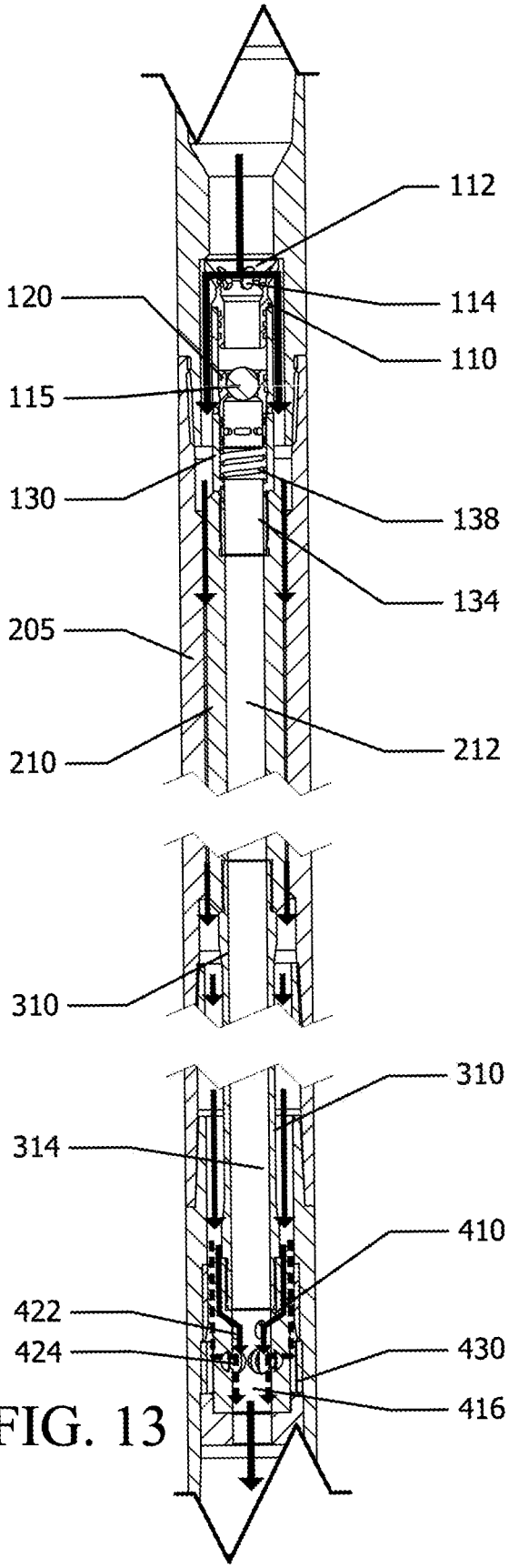

The operation of the combination assembly 100 is described with reference to FIGS. 12 and 13, which illustrate in particular the effect of the selective engagement of the activation tool 60 and the pulsing unit 80 on fluid flow in the assembly 100. These figures illustrate a section of a simplified version of the connection assembly 100 containing the activation tool 60 (i.e., the ball catch assembly comprising components 110, 120, 130), the motor section 70 comprising stator 205 and rotor 210, and the pulsing unit 80 (i.e., the variable choke assembly comprising components 410, 430), with only a single drive shaft 310 connecting the rotor 210 to the rotating component 410. In FIG. 12, the activation tool 60 (the ball catch assembly) is not in an engaged state. No projectile is in place in the ball catch seat 120; consequently, drilling fluid entering the ball catch assembly from above can flow into the bore 134 of the ball catch retainer 130 and into the bore 212 of the rotor 210, as indicated by arrows in FIG. 12. The fluid exits the bore 212 and passes through the bore 314 of the drive shaft 310, and the bore 416 of the rotary component 410. Since most fluid enters the bore 212, it does not activate the rotor 210. If the reduced interior diameter due to the shape of the ball catch seat 120 causes a significant restriction in the flow of drilling fluid, the bypass ports 140 may permit some drilling fluid to flow from the interior of the ball catch assembly to the annular space surrounding the exterior of the ball catch retainer 130. This diverted fluid may enter the uppermost cavity of the motor, but will not necessarily activate the motor; or, if the motor is activated, the amount of torque generated by the motor ultimately may not have an appreciable effect in the friction reduction tool 50.

The fluid then passes into the bore 416 of the rotary component 410. Most drilling fluid entering the ball catch assembly will pass through the centre bore 212 of the rotor, and bores 314 and 416. However, if any fluid happens to reach the exterior of the rotary component 410, it may enter one of the bypass ports 422 and enter the bore 416 in that way; and if the rotary component 410 is in an "open" or partially-"open" position, some fluid may even enter the bore 416 via the flow ports 424 to the extent they are not blocked off. Thus, when the activation tool 60 is in the non-engaged state, the substantial part of the drilling fluid flows through the communicating bores of the various components with minimal variation in fluid pressure.

On the other hand, when the activation tool 60 is in the engaged state, a ball 115 or other blocking projectile is seated in the ball catch seat 120. This causes drilling fluid to be substantially blocked from passing through the bore 134. As indicated by the arrows in FIG. 13, drilling fluid is therefore directed from the ball catch head 110, through the ports 114 in the funnel 112, and down the exterior of the ball catch retainer 130 toward the cavities of the motor defined by the rotor 210 and stator 205. This provides sufficient flow to activate the motor, causing rotation of the rotor 210, thereby driving the rotary component 410 of the variable choke assembly. Minimal fluid will pass through the rotor bore 212 and drive shaft bore 314. The drilling fluid exiting the motor passes around the exterior of the drive shaft 310 and the exterior of the rotary component 410, which is rotating. Some fluid will enter the bypass ports 422 of the rotary component 410, while other fluid will intermittently enter the flow ports 424 as rotary component 410 rotates and the flow ports 424 move into and out of alignment with the channels 438 in the stationary ring component 430, as indicated by the phantom arrows in FIG. 13. The varying rate of fluid consequently entering the bore 416 will produce variations in the fluid pressure above the rotary component 410. These pressure variations are communicated to the drilling fluid below the piston 540, thereby activating the oscillation unit 50. It will be appreciated that even while pressure variations are being generated by the variable choke assembly, the assembly 100 still permits a significant amount of fluid to flow downstream to other drilling string components, such as the drill bit and its motor. This is because the rotary component of the variable choke assembly includes the bypass ports 422, permitting drilling fluid to bypass flow ports 424 even when the flow ports 424 are closed.

In some implementations, an activation tool 60 such as the example described above may be selectively deactivated as well as activated. For example, a dart or plug projectile may be provided with a hook, hole, or protuberance at its upper end. It could then be retrieved from its position in an activation tool 60 using a wireline tool provided with a corresponding hook or clamp that attaches to the upper end of the projectile, then is retracted to bring the projectile back to surface. As another example, the blocking projectile may be formed of a breakable material, such as Teflon®. After the activation tool 55 is placed in the engaged state and the projectile is in place within the tool 55, the projectile may be subsequently fractured by dropping a fracture implement (not shown), such as a smaller stainless steel ball, to shatter the projectile, thus returning the activation tool 60 to a non-engaged state. The fragments of the shattered projectile can be flushed out of the activation tool 60 by drilling fluid.

As mentioned above, in a drilling string assembly 30 with multiple activation tool-friction reduction tool combinations such as the combination assembly 100, the tools can be configured to permit selective activation of a particular one of the friction reduction tools. For example, where the activation tools 60 use ball catch assemblies, the internal diameters of the components of the uphole friction reduction tools and activation tools can be sized to permit passage of projectiles to the downhole friction reduction and activation tools. For instance, the ball catch assemblies can be sized to catch and retain balls or other projectiles of serially increasing or graduated size from the bottom of the drilling string assembly 30 to the top. The first activation tool 60 (closest to the bit) would thus be configured to catch the smallest size ball or projectile, and the second activation tool 60 would be configured to permit the smallest size ball or projectile to pass through to the first activation tool 60 while catching and retaining a larger size ball or projectile, and so forth. The bores provided in all other components of the drilling string assembly 30, such as the oscillation units 50 and rotary valve components 410, and so forth, would also be sized to permit passage of projectiles through to downstream tools.

The foregoing examples of FIGS. 6A through 13 illustrate a particular type of combination activation tool 60 and friction reduction tool for use with the lateral drilling method described above. However, those skilled in the art will appreciate that variations of these tools will still fall within the inventive concept described herein. The activation tool 60 need not be a ball catch assembly or similar projectile-catching assembly; instead, the activation tool 60 can comprise any suitable apparatus that can selectively activate (and optionally selectively deactivate) a friction reduction tool by causing drilling fluid to be directed away from or into appropriate passages that result in motor activation. For example, an activation tool 60 may comprise a servo-actuated valve that modifies drilling fluid flow and is controlled by an electric circuit. The activation tool may also operate as the pulsing unit, in which case a distinct pulsing unit 80 may not be required. The oscillation unit 50 described here is a tool that induces a vibrational or oscillating motion in a drilling string, and can include a combination of components (e.g., spring assemblies, etc.) arranged to produce the desired motion in response to drilling fluid flow or drilling fluid pressure through or in the unit 50. However, the selection of an appropriate friction reduction tool and/or oscillation unit 50 may depend on operational factors such as the characteristics of the formation through which the wellbore is being drilled, the type and viscosity of the drilling fluid used during drilling, and the weight and configuration of other components in the drilling string assembly 30.

Figure 14:
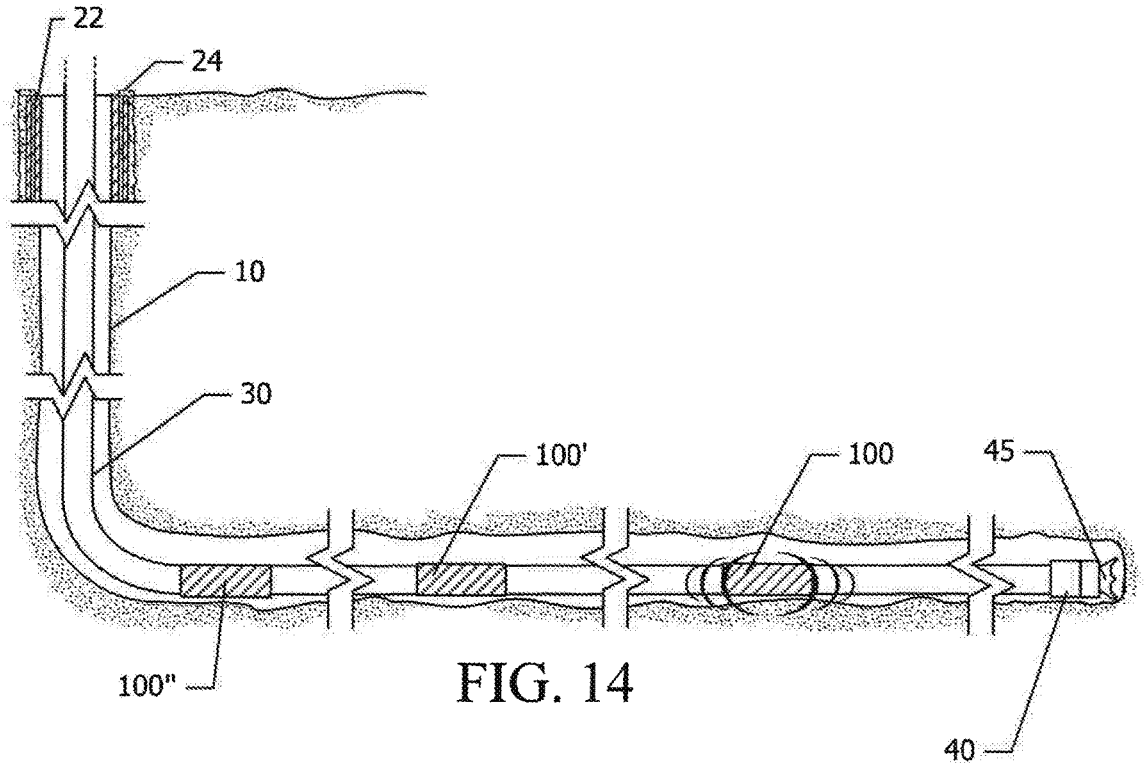
FIGS. 14 and 15 are schematics illustrating activation of one or more of the combination assemblies in the drilling string of FIG. 5.
Figure 15:
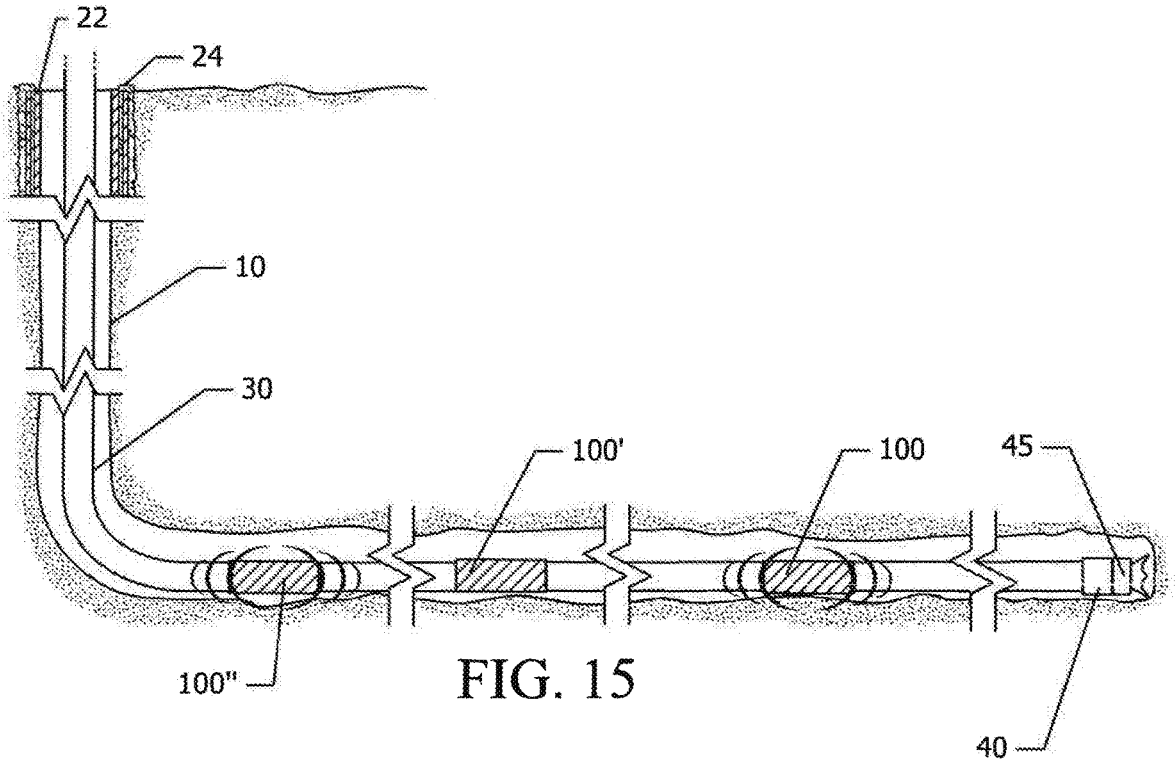

Turning to FIGS. 14 and 15, lateral drilling proceeds as the additional friction reduction tools and their corresponding activation tools are added to the drilling string assembly 30, and after a suitable number of tools have been added to the string assembly 30. It will be appreciated that drilling can occur while at least one of the friction reduction tools is still located in the vertical section 11 or build section 12 of the wellbore 10; it is not necessary for all friction reduction tools to be located in the lateral section 13. Once at least a first oscillation unit 60 is located in the lateral section 13 or has at least cleared the casing in the vertical section 11, the combination assembly 100 can be activated to overcome or reduce friction detected in the string assembly 30 even if another one of the combination assemblies 100', 100" is still located in the vertical or build sections 11, 12. For example, if friction is detected in the lateral portion of the drilling string assembly 30 near the BHA 40 and the inherent weight of the drilling string components is not sufficiently effective in providing sufficient weight transfer to overcome the friction, the first friction reduction tool in the assembly 100 nearest the BHA 40 can be activated as described above. The first friction reduction tool will thus generate vibrational motion, as indicated in FIG. 6, while the other friction reduction tools in other assemblies 100', 100" remain inactivated. If the example implementation of FIGS. 6A to 13 is employed, then the bore dimensions of the various components in the each friction reduction tool-activation tool combination will be graduated, as mentioned above. In this case, the first activation tool 60 would be configured to catch and retain the smallest size ball or other blocking projectile, and the smallest size ball would be sized to pass through the bores of the second, third, and other sets of friction reduction tool-activation tool combinations in the drilling string assembly 30. Thus, to activate the first friction reduction tool 50, the operator may drop a ball or other projectile in the drilling string, and allow the drilling fluid flow to assist in moving the ball through the third and second combination assemblies 100', 100" to the first activation tool 60 in the first combination assembly 100. It will be appreciated, however, that the first activation tool 60 in the first combination assembly 100 need not be configured to permit a blocking projectile to pass through as there may be no need to permit an intact blocking projectile to pass through to the BHA.

If it is subsequently determined that frictional forces are overcoming the effectiveness of the activated friction reduction tool in the first assembly 100, at least one further assembly 100', 100" can be activated to impart further vibration to the drilling string assembly 30, for example by dropping an appropriately sized projectile into the string assembly 30. In the example of FIG. 15, the third assembly 100" has been activated, for example as described above. Alternatively, the second assembly 100' may be activated, or both the second and third assemblies 100', 100" may be activated. Friction reduction tools within in the drilling string assembly 30 may thus continue to be activated in this manner until the total length of the wellbore 10 has been reached, or until the maximum allowable drilling fluid pressure at surface (which is affected by the operation of the friction reduction tools) has been reached or exceeded.

It will be appreciated by those skilled in the art that activation of the various assemblies 100, 100', and 100" need not wait until friction between the drilling string assembly 30 and the wellbore is actually detected or suspected in the lateral section 13. Indeed, in a further variant, a number of assemblies 100, 100', 100" can be added to the drilling string assembly 30 as the assembly 30 is built and extended into the wellbore, with each assembly 100, 100', 100" being activated after it has cleared the casing 22 and cement 24 to avoid damage, even while one or more of the assemblies 100, 100', 100" is in the vertical 11 or build 12 portion of the wellbore rather than the lateral section 13. It will also be appreciated that in some implementations, activation of the friction reduction tools in assemblies 100, 100', 100" need not mean that the friction reduction tools must be activated from a zero-energy state (e.g., no kinetic motion) to a higher-energy state. Due to drilling fluid flow through the drilling string assembly 30, the friction reduction tools may in fact be generating vibrations in a lower-energy state even when the corresponding activation tool is not engaged (i.e., the friction reduction tool is not "activated"), but the vibrations may not be sufficient to noticeably mitigate the effects of friction in the wellbore, or to damage the casing. When a friction reduction tool in an assembly is "activated", however, the vibrations will be sufficient to mitigate at least some of the effects of friction.

The drilling method and drilling string assembly 30 described above thus provide for improved efficiency in drilling lateral wellbores, by permitting the addition of multiple friction reduction tools that can be selectively activated to reduce friction at selected locations along the lateral portion 13 of the drilling string 30, even when one or more friction reduction tools are still located in the vertical or build sections 11, 12 of the wellbore. Moreover, by employing combination friction reduction-activation assemblies such as the assembly 100 described above, drilling fluid can continue to flow through the drilling string assembly 30 whether the various assemblies 100, 100', 100" are activated or not, and it may be possible to obtain higher drilling fluid flow rates towards the bottom of the wellbore and drill bit than are obtainable with prior art friction reduction tools. Higher flow rates can enable the motor driving the bit to be run at higher speeds or greater torque, and improve cleaning at the bit. This may reduce the need for the operator to increase the fluid pressure at the surface in order to operate components downstream from the friction reduction tool. Furthermore, because the friction reduction tools in the assemblies 100, 100', 100" are selectively activatable using their corresponding activation tools, the friction reduction tools can be added to the drilling string 30 as the drilling string is assembled at the surface. It is not necessary to cease drilling operations and retract a drilling string, disassemble, and reassemble the drilling string with a friction reduction tool. A friction reduction tool can be located within the vertical section 11 of the wellbore 10 without being activated, even if another friction reduction tool in the drilling string assembly 30 is activated in the lateral section 13. This reduces the risk of damage to the casing 22 and cement 22 in the vertical section 11. It may be noted that during operation, debris or particulate matter in the drilling fluid may cause blockages in portions of the drilling string assembly 30, possibly with the unintended result of activating the friction reduction tool, although activation of the friction reduction tool may disperse the blockage.

The performance of the method and drilling string assembly 30 may be enhanced by using drill pipe having a higher stiffness to weight ratio that typical drill pipe or HWDP to connect the various friction reduction and activation tools. Such stiff drill pipe may provide greater strength than typical drill pipe, but without contributing the same additional weight as HWDP. The use of a pipe with a higher stiffness to weight ratio may assist in weight transfer at the bit or within the lateral portion of the assembly 30 without the same undesirable impact of HWDP weight on frictional forces inside the wellbore.

Throughout the specification, terms such as "may" and "can" are used interchangeably and use of any particular term in describing the examples and embodiments should not be construed as limiting the scope or requiring experimentation to implement the claimed subject matter or subject matter described herein. Various embodiments of the present invention or inventions having been thus described in detail by way of example, it will be apparent to those skilled in the art that variations and modifications may be made without departing from the invention(s).

The inventions contemplated herein are not intended to be limited to the specific examples set out in this description. The inventions include all such variations and modifications as fall within the scope of the appended claims.

The invention claimed is:

1. A drilling method, comprising:

activating a first friction reduction tool in a drilling string:

drilling a portion of a wellbore using a drilling string comprising a bottom hole assembly and the active first friction reduction tool connected to the drilling string at a first interval above the bottom hole assembly;

connecting a second friction reduction tool to the drilling string at a second interval above the active first friction reduction tool, wherein the second friction reduction tool comprises a variable choke assembly having a rotary component and a stationary component, and an oscillating unit, each of the rotary component and stationary component being provided with passages that enter into and out of alignment when the rotary component rotates with respect to the stationary component, the rotary component being drivable by a rotor of a motor of the second friction reduction tool;

the rotary component, stationary component, and rotor each comprising a central bore defining a central passage permitting drilling fluid flow from above the second friction reduction tool to below the second friction reduction tool;

activating the second friction reduction tool in the drilling string while the active frat friction reduction tool is active, wherein activating the second friction reduction tool comprises:

blocking the drilling fluid flow through the central passage with a projectile to divert the drilling fluid flow through the motor to thereby activate the rotor and drive the rotary component, wherein at least some fluid enters the passages of the rotary and stationary components as the rotary component rotates, thereby producing fluid pressure pulses to activate the oscillating unit.

2. The drilling method of claim 1, wherein the portion of the wellbore is a substantially lateral section of the wellbore.

3. The drilling method of claim 1, wherein blocking the drilling fluid flow through the central passage with a projectile comprises receiving the projectile in an activation tool positioned in the drilling string above the second friction reduction tool, the activation tool comprising a seat for receiving the projectile and a central bore in fluid communication with the central passage.

4. The drilling method of claim 1, wherein:

the stationary component comprises a ring, and the passage provided in the stationary component comprises a channel in an interior face of the ring;

the passage provided in the rotary component comprises a port extending from an exterior face of the rotary component to the central bore of the rotary component; and the rotary component is positioned in the stationary component such that the port of the rotary component enters into and out of alignment with the channel of the stationary component as the rotary component rotates.

5. The drilling method of claim 1, wherein the rotary component is connected to the rotor by a drive shaft, the drive shaft having a central bore further defining the central passage.

6. The drilling method of claim 1, further comprising deactivating the second friction reduction tool by removing the projectile.

7. The drilling method of claim 6, wherein removing the projectile comprises retrieving the projectile using a wireline tool.

8. A drilling method, comprising:

drilling a portion of a wellbore using a drilling string comprising a bottom hole assembly and a first friction reduction tool connected to the drilling string at an interval above the bottom hole assembly, the first friction reduction tool comprising a variable choke assembly having a rotary component and a stationary component, and an oscillating unit, each of the rotary component and stationary component being provided with passages that enter into and out of alignment when the rotary component rotates with respect to the stationary component, the rotary component being drivable by a rotor of a motor of the first friction reduction tool;

the rotary component, stationary component, and rotor each comprising a central bore defining a first central passage from above the first friction reduction tool to below the first friction reduction tool; and extending a wireline tool through the drilling string through the first central passage to below the friction reduction tool.

9. The drilling method of claim 8, wherein a further friction reduction tool is connected to the drilling string between the first friction reduction tool and the bottom hole assembly, the further friction reduction tool comprising a variable choke assembly having a same configuration as the variable choke assembly as the first friction reduction tool, the further friction reduction tool comprising a further central passage from above the second friction reduction tool to below the second friction reduction tool, the first central passage and the further central passage permitting drilling fluid flow from above the first friction reduction tool to the bottom hole assembly.

10. A method of drilling a substantially lateral section of a wellbore using a drilling string, the wellbore comprising a substantially vertical section and a build section connecting the substantially vertical wellbore section and the substantially lateral section, the method comprising:

at a first determined interval of drill pipe above a bottom hole assembly, connecting a first friction reduction tool and a first activation tool, the first activation tool being in operable communication with the first friction reduction tool for activating the first friction reduction tool, the first friction reduction tool and the first activation tool providing a first friction reduction segment;

at a further determined interval of the drilling string above the first friction reduction segment, connecting a further friction reduction tool and a further activation tool to the drilling string to provide a further friction reduction segment;

after the further friction reduction tool is connected, activating the first friction reduction tool using the first activation tool while at least the first friction reduction tool is positioned in the substantially lateral section of the wellbore; and drilling a portion of the substantially lateral section of the wellbore using the drilling string while the first friction reduction tool is activated and the further friction reduction tool is not activated, wherein each friction reduction tool comprises a variable choke assembly having a rotary component and a stationary component, each of the rotary component and stationary component being provided with passages that enter into and out of alignment when the rotary component rotates with respect to the stationary component, the rotary component being drivable by a rotor of a motor connected to the rotary component, each friction reduction tool having a central passage permitting drilling fluid flow from above the friction reduction tool to below the friction reduction tool, the central passage of the first friction reduction tool being smaller in diameter than the central passage of the further friction reduction tool, wherein activating the first friction reduction tool comprises passing a first projectile through the passage of the further friction reduction tool and receiving the first projectile in the first activation tool, the first projectile substantially blocking the central passage and directing fluid flow into the motor and the passages of the variable choke assembly of the first friction reduction tool to cause the rotary component to rotate and the variable choke assembly to generate fluid pressure pulses.

11. The method of claim 10, wherein the first friction reduction tool is activated while the further friction reduction tool is positioned in either the substantially vertical section or the build section of the wellbore.

12. The method of claim 10, further comprising drilling further portions of the substantially lateral section of the wellbore until the further friction reduction tool is positioned in the substantially lateral section.

13. The method of claim 12, further comprising activating the further friction reduction tool using the further activation tool while the further friction reduction tool is positioned in the substantially lateral section, wherein activating the further friction reduction tool comprises receiving a further projectile in the further activation tool, the further projectile substantially blocking the central passage of the further friction reduction tool and directing fluid flow into the motor and the passages of the variable choke assembly of the further friction reduction tool to cause the rotary component to rotate and the variable choke assembly to generate fluid pressure pulses.

14. The method of claim 10, wherein connecting the further friction reduction tool, further activation tool, and drilling pipe, is repeated to provide at least three friction reduction segments in the drilling string.

15. The method of claim 10, wherein the bottom hole assembly comprises a drill bit and a corresponding motor.

16. The method of claim 10, wherein the bottom hole assembly comprises at least one logging while drilling or measurement while drilling instrument.

17. The method of claim 10, wherein the first and further activation tools comprise a ball drop activation tool.

18. The method of claim 10, wherein:

the stationary component comprises a ring, and the passage provided in the stationary component comprises a channel in an interior face of the ring;

the passage provided in the rotary component comprises a port extending from an exterior face of the rotary component to the central bore of the rotary component; and the rotary component is positioned in the stationary component such that the port of the rotary component enters into and out of alignment with the channel of the stationary component as the rotary component rotates.

19. The method of claim 10, wherein in each friction reduction tool, the rotary component is connected to the rotor using a drive shaft having a central passage.

* * * * *